US009655799B1

(12) United States Patent
Walder, III

(10) Patent No.: US 9,655,799 B1
(45) Date of Patent: May 23, 2017

(54) STABILIZING TURNING AID

(71) Applicant: Paul Walder, III, Jackson, NJ (US)

(72) Inventor: Paul Walder, III, Jackson, NJ (US)

( * ) Notice: Subject to any disclaimer, the term of this patent is extended or adjusted under 35 U.S.C. 154(b) by 0 days.

(21) Appl. No.: 15/078,969

(22) Filed: Mar. 23, 2016

Related U.S. Application Data

(60) Provisional application No. 62/138,345, filed on Mar. 25, 2015.

(51) Int. Cl.
*A61H 3/00* (2006.01)
*A61G 7/10* (2006.01)
*A61H 3/02* (2006.01)

(52) U.S. Cl.
CPC ..... *A61G 7/1038* (2013.01); *A61H 3/0277* (2013.01); *A61H 3/0288* (2013.01)

(58) Field of Classification Search
CPC ... A61G 3/1038; A61H 3/0277; A61H 3/0288
USPC ..... 135/65, 67, 84, 86; 108/139
See application file for complete search history.

(56) References Cited

U.S. PATENT DOCUMENTS

| | | | | |
|---|---|---|---|---|
| 2,792,052 | A | 5/1957 | Johannesen | |
| 5,226,439 | A * | 7/1993 | O'Keeffe | A47C 7/62 135/66 |
| 5,785,070 | A * | 7/1998 | Block | A45B 9/00 135/65 |
| 6,231,067 | B1 | 5/2001 | Johnson | |
| 7,637,274 | B1 | 12/2009 | Dodson | |
| 8,726,922 | B2 * | 5/2014 | Pak | A61H 3/00 135/67 |
| 8,919,362 | B1 * | 12/2014 | Mortenson | A45B 9/04 135/66 |
| 8,936,033 | B2 * | 1/2015 | Velarde | A61H 3/00 135/67 |
| 2015/0075575 | A1 * | 3/2015 | Karlovich | A63B 69/0064 135/66 |

* cited by examiner

*Primary Examiner* — Todd M Epps
(74) *Attorney, Agent, or Firm* — RG Patent Consulting, LLC; Rachel Gilboy

(57) ABSTRACT

The stabilizing turning aid system is a support platform that is specially designed for assisting mobility-challenged users in rising from and sitting in a chair, and to improve the ability of a physically challenged person to pivot their entire body with minimal body movement for greater mobility.

20 Claims, 4 Drawing Sheets

STABILIZING TURNING AID

CROSS-REFERENCE TO RELATED APPLICATION

The present application is related to and claims priority from prior provisional application Ser. No. 62/138,345 filed Mar. 25, 2015 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of walker devices and more specifically relates to a support platform that is specially designed for assisting patients in rising from and sitting in a chair to provide mobility-challenged users, and their caregivers, with a safer and easier means of managing this task.

2. Description of the Related Art

With today's heightened awareness of health concerns and constantly improving medical care, Americans are living longer than ever before. As the baby boomer generation gets older, dramatic increases are expected in the elderly population. In fact, the U.S. Bureau of the Census estimates that people 65 and older will comprise 20.4 percent of the country's population by the year 2030, up from the current 13 percent. However, if the unprecedented increase in life expectancy has a downside, it is the exposure of risk to chronic age-related disorders. Such serious ailments as diabetes, Alzheimer's and Parkinson's diseases are but a few of the disabling disorders that keep many older persons from enjoying their longevity.

Additionally, the elderly also have to deal with physical infirmities brought on by the inevitability of aging. The scientific journal *Age and Aging* reports that some 50% of persons over age 65 have osteoarthritis, and one-half of those are seriously disabled by it. However, challenges presented to those with limited mobility are not exclusive to the elderly. According to other statistics provided by the Census Bureau, nearly 8 percent of Americans between the ages of 15 and 64 suffer from some form of disability that hinders independent movement. Adding to these numbers are those with more temporary ailments, such as broken bones or postoperative conditions.

As many with limited mobility can easily attest, attempting to complete day to day tasks without assistance can be daunting and frustrating. Patients often find it very difficult, if not impossible, to lower themselves to or rise from a seated position without experiencing extreme pain, even with a caregiver to lend a hand. Moreover, once the patient is standing, it can be challenging for the caregiver to safety rotate him or her without twisting the knee joint. As such, it is often necessary for two assistants to help stabilize the patient; unfortunately, having more than one caregiver on hand is not an option for many, especially those under home care.

Various attempts have been made to solve the above-mentioned problems such as those found in U.S. Pat. No. 2,792,052 to Johannesen Hans Arne Ingolf; U.S. Pat. No. 7,637,274 to Rodney Dodson; and U.S. Pat. No. 6,231,067 to Jay A. Johnson. This art is representative of walkers and devices that allow a physically challenged person to pivot their entire body with minimal body movement. None of the above inventions and patents, taken either singly or in combination, is seen to describe the invention as claimed.

Ideally, a walker device should provide a support platform that is specially designed for assisting patients in rising from and sitting in a chair to provide mobility-challenged users, and their caregivers, with a safer and easier means of managing this task and, yet would operate reliably and be manufactured at a modest expense. Thus, a need exists for a reliable stabilizing turning aid system to avoid the above-mentioned problems.

BRIEF SUMMARY OF THE INVENTION

In view of the foregoing disadvantages inherent in the known walker device art, the present invention provides a novel Stabilizing Turning Aid. The general purpose of the present invention, which will be described subsequently in greater detail is to provide a support platform that is specially designed for assisting patients in rising from and sitting in a chair to provide mobility-challenged users, and their caregivers, with a safer and easier means of managing this task.

A stabilizing turning aid system is disclosed herein in a preferred embodiment comprising: a base plate including a top side having a plurality of hand rails, a toe stop and a padded cross bar. It further has a bottom side with a bearing assembly and a plurality of glide pads. The hand rails are adapted to allow a user to pull upward to achieve a standing position, then be able to stand on the baseplate between hand rails with the users feet against the toe plate, maintain balance and control, and have an assistant rotate the baseplate on the bearing assembly and glide pads as needed to place the user in front of a chair or bed, allowing the user to sit in the chair for transportation to another location as needed.

The hand rails are mounted in a parallel fashion on the top side of the base plate, and spaced to allow a user to stand between hand rails for stability. The base plate has a rectangular shape to allow attachment of hand rails to the top side with necessary spacing between hand rails for a user to stand. The rectangular shape of the base plate has dimensions of about 24 inches in length and about 26 inches in width to allow adequate spacing of the hand rails which enables sufficient room for a user to stand between as needed, and is manufactured with ¾" plywood for sufficient weight bearing capability.

The hand rails comprise ferrous material for strength and durability to allow a user to grip the hand rails and pull to a standing position, and provide side to side and forward-backward stability for the user when in-use. The stabilizing turning aid system provides mobility challenged users, and their caregivers with a safe and easy way to re-locate a user from one location to another when in-use. The bearing assembly facilitates rotation of the base plate while in use, with the bearing assembly being 20 inches in diameter and adapted to distribute a user's weight evenly thereon. The bearing assembly is manufactured with a durable, ferrous material for weight bearing effectiveness, and longevity of use. The padded cross bar is adapted to allow a user to lean on as needed for stabilization, and provides vertical stability of hand rails for safety.

The toe stop keeps a user from slipping when stepping on the base plate for safety, and is adapted to guide a user's feet to an ideal standing position on the base plate, which is directly over the bearing assembly for ideal weight distribution, and proper bearing operation. The plurality of glide pads are mounted on the bottom side of the base plate to provide horizontal stability while in use. The plurality of glide pads rotate in conjunction with the bearing assembly when rotation of the base plate is executed, and comprise a material which will not scratch a floor when rotating the system. The stabilizing turning aid is adapted to be left in place after use until necessary to move the user again as needed.

The present invention holds significant improvements and serves as a device that allow a physically challenged person to pivot their entire body with minimal body movement. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, stabilizing turning aid constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a walker device and more particularly to a support platform that is specially designed for assisting mobility-challenged users in rising from and sitting in a chair, and to improve the ability of a physically challenged person to pivot their entire body with minimal body movement for greater mobility.

Generally speaking, a stabilizing turning aid is rectangular in shape, constructed of injection molded plastic, or similar material, and measuring approximately twenty-four inches in length and twenty-six inches in width. Underneath this base, a circular assembly consisting of twenty inch bearings would be provided to facilitate the rotation of the unit. On the top, the Stabilizing Turning Aid would offer a raised section, or toe stop, to help guard against slippage when a patient steps onto the platform. Support for the Stabilizing Turning Aid would be provided by a built in aluminum walker device that, like standard walkers, provides sure stabilization at the front and on each side of a user.

Figure 1:
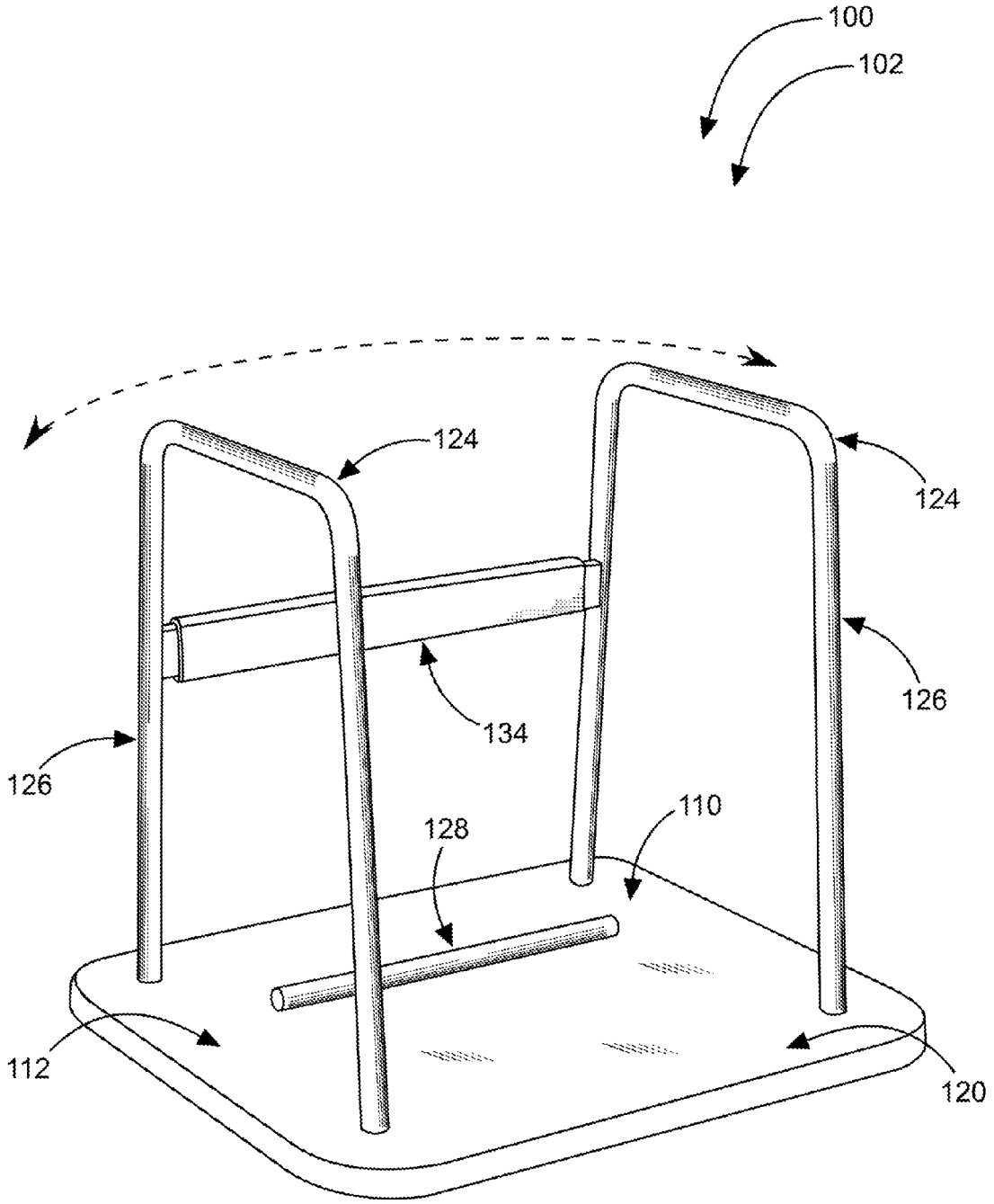
FIG. 1 shows a perspective view illustrating an in use condition of a stabilizing turning aid according to an embodiment of the present invention.

Referring to the drawings by numerals of reference there is shown in FIG. 1, a perspective view illustrating an in-use condition 102 of stabilizing turning aid system 100 according to an embodiment of the present invention.

Stabilizing turning aid system 100 is disclosed herein in a preferred embodiment comprising: base plate 110 including top side 120 having plurality of hand rails 124, toe stop 128 and padded cross bar 134. It further has bottom side 140 with bearing assembly 144 and plurality of glide pads 150. Plurality of hand rails 124 are adapted to allow a user to pull upward to achieve a standing position, then be able to stand on baseplate 110 between plurality of hand rails 124 with the users feet against toe stop 128, maintain balance and control, and have an assistant rotate baseplate 110 on bearing assembly 144 and plurality of glide pads 150 as needed to place the user in front of a chair or bed, allowing the user to sit in the chair for transportation to another location as needed.

Figure 2:
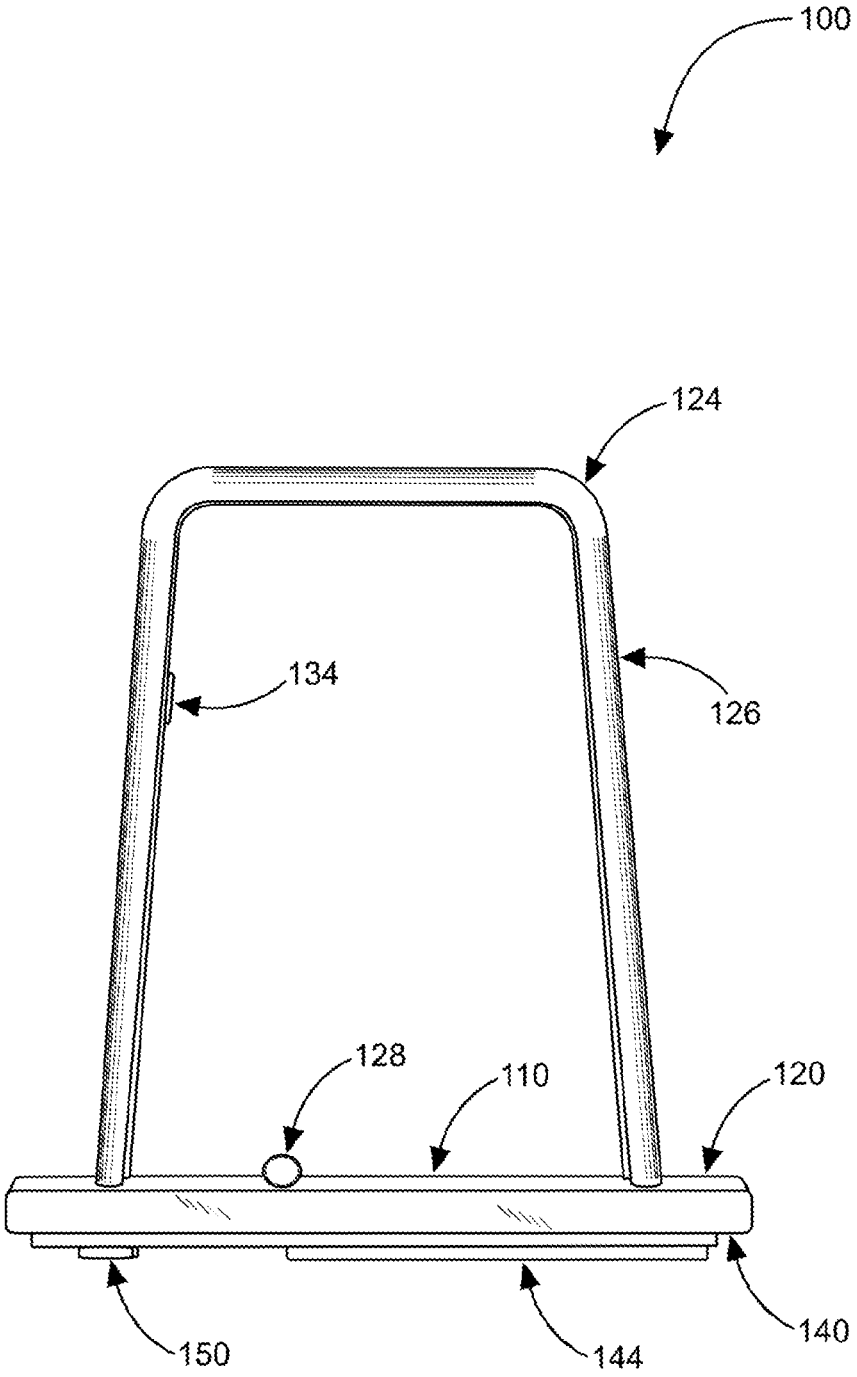
FIG. 2 is a side view illustrating a stabilizing turning aid according to an embodiment of the present invention of FIG. 1.

Referring now to FIG. 2, a side view illustrating stabilizing turning aid system 100 according to an embodiment of the present invention.

Plurality of hand rails 124 are mounted in a parallel fashion on top side 120 of base plate 110, and spaced to allow a user to stand between plurality of hand rails 124 for stability. Base plate 110 has a rectangular shape to allow attachment of plurality of hand rails 124 to top side 120 with necessary spacing between plurality of hand rails 124 for a user to stand. The rectangular shape of base plate 110 has dimensions of about 24 inches in length and about 26 inches in width to allow adequate spacing of plurality of hand rails 124 which enables sufficient room for a user to stand between as needed, and is manufactured with ¾" plywood 112 for sufficient weight bearing capability.

Figure 3:
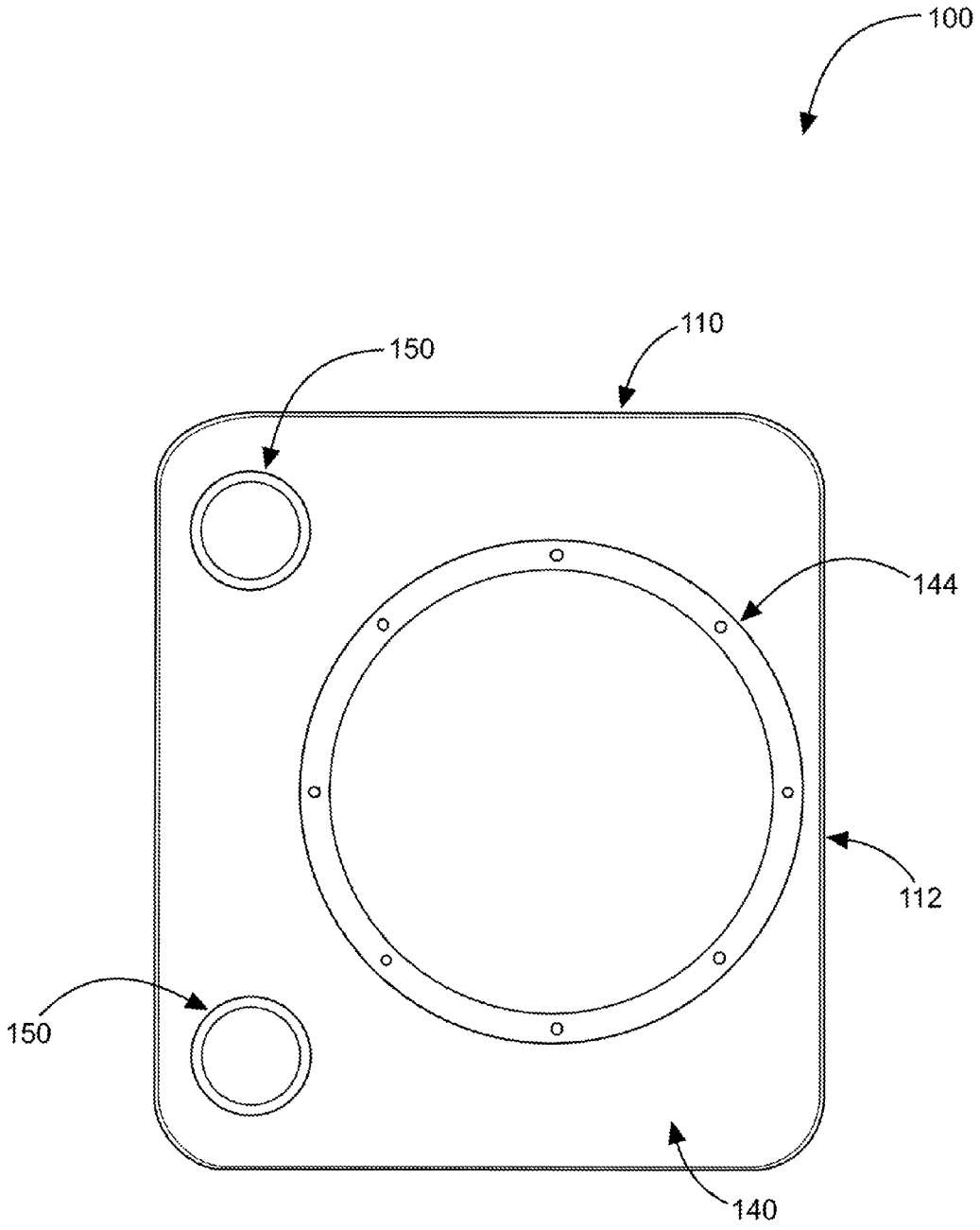
FIG. 3 is a bottom view illustrating stabilizing turning aid according to an embodiment of the present invention of FIG. 1.

Referring now to FIG. 3, a bottom view illustrating stabilizing turning aid system 100 according to an embodiment of the present invention.

Plurality of hand rails 124 comprise ferrous material 126 for strength and durability to allow a user to grip plurality of hand rails 124 and pull to a standing position, and provide side to side and forward-backward stability for the user when in-use. The stabilizing turning aid system 100 provides mobility challenged users, and their caregivers with a safe and easy way to re-locate a user from one location to another when in-use. Bearing assembly 144 facilitates rotation of base plate 110 while in use, with bearing assembly 144 being 20 inches in diameter and adapted to distribute a user's weight evenly thereon. Bearing assembly 144 is manufactured with a durable, ferrous material for weight bearing effectiveness, and longevity of use. Padded cross bar 134 is adapted to allow a user to lean on as needed for stabilization, and provides vertical stability of plurality of hand rails 124 for safety.

Figure 4:
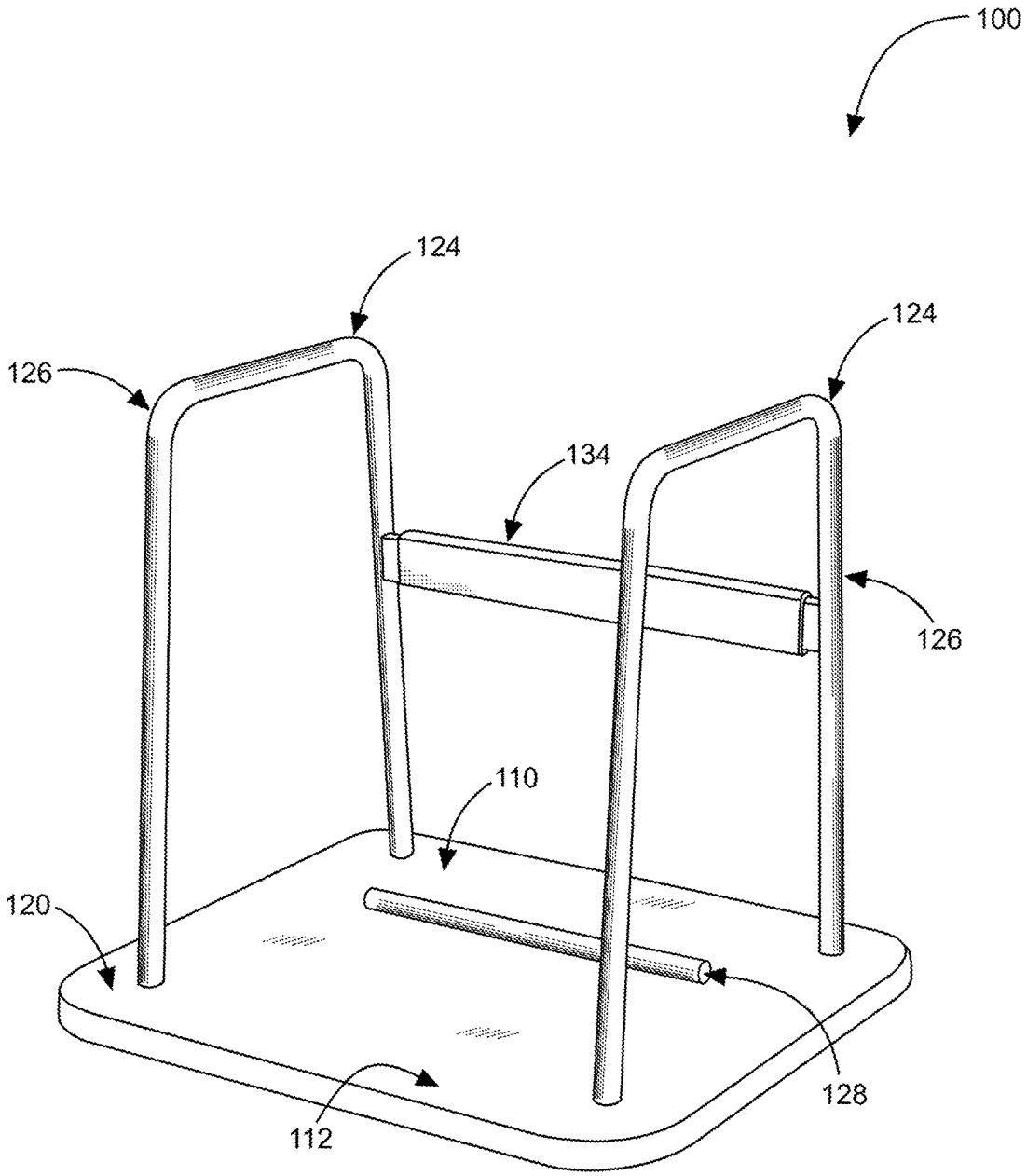
FIG. 4 is another perspective view illustrating stabilizing turning aid according to an embodiment of the present invention of FIG. 1.

Referring now to FIG. 4, another perspective view illustrating stabilizing turning aid system 100 according to an embodiment of the present invention.

Toe stop 128 keeps a user from slipping when stepping on base plate 110 for safety, and is adapted to guide a user's feet to an ideal standing position on base plate 110, which is directly over bearing assembly 144 for ideal weight distribution, and proper bearing operation. Plurality of glide pads 150 are mounted on bottom side 140 of base plate 110 to provide horizontal stability while in use. Plurality of glide pads 150 rotate in conjunction with bearing assembly 144 when rotation of base plate 110 is executed, and comprise a material which will not scratch a floor when rotating the system. The stabilizing turning aid system 100 is adapted to be left in place after use until necessary to move the user again as needed.

Stabilizing turning aid system 100 may be manufactured and provided for sale in a wide variety of sizes and shapes for a wide assortment of applications.

Upon reading this specification, it should be appreciated that, under appropriate circumstances, considering such issues as design preference, user preferences, marketing preferences, cost, structural requirements, available materials, technological advances, etc., including more or less components, customized parts, different color combinations, parts may be sold separately, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A stabilizing turning aid system comprising:

a base plate including;

a top side having;

a plurality of hand rails;

a toe stop; and a padded cross bar;

a bottom side having;

a bearing assembly; and a plurality of glide pads;

wherein said top side of said base plate comprises said plurality of hand rails, said toe stop, and said padded cross bar in combination, and said bottom side of said base plate comprises said bearing assembly and said plurality of glide pads in functional combination; and wherein said hand rails are adapted to allow a user to pull upward to achieve a standing position, said user then able to stand on said baseplate between said hand rails with users feet against said toe stop, and maintain balance and control, an assistant is then able to rotate said base plate on said bearing assembly and said glide pads as needed to place said user in front of a chair or bed, allowing said user to sit in said chair for transportation to another location as needed.

2. The stabilizing turning aid system of claim 1 wherein said hand rails are mounted in a parallel orientation on said top side of said base plate, and spaced to allow said user to stand there-between said hand rails for stability.

3. The stabilizing turning aid system of claim 2 wherein said base plate comprises a rectangular shape to allow attachment of said hand rails to said top side with necessary spacing between said hand rails for said user to stand.

4. The stabilizing turning aid system of claim 3 wherein said rectangular shape of said base plate comprises dimensions of about 24 inches in length and about 26 inches in width to allow spacing of said hand rails which enables sufficient room for said user to stand between said hand rails as needed.

5. The stabilizing turning aid system of claim 4 wherein said base plate comprises ¾" plywood for sufficient weight bearing capability.

6. The stabilizing turning aid system of claim 2 wherein said hand rails comprise ferrous material for strength and durability to allow said user to grip said hand rails and pull to said standing position.

7. The stabilizing turning aid system of claim 6 wherein said hand rails provide stability of said user when in an in-use condition.

8. The stabilizing turning aid system of claim 7 wherein said hand rails provide side to side and forward-backward stability of said user while in use.

9. The stabilizing turning aid system of claim 1 wherein said stabilizing turning aid system provides mobility challenged said users, and their caregivers with a safe and easy way to re-locate said user from one location to a different location when in-use.

10. The stabilizing turning aid system of claim 1 wherein said bearing assembly facilitates rotation of said base plate while in use.

11. The stabilizing turning aid system of claim 10 wherein said bearing assembly is 20 inches in diameter and adapted to distribute said users weight evenly thereon.

12. The stabilizing turning aid system of claim 11 wherein said bearing assembly comprises ferrous material for weight bearing effectiveness, and longevity of use.

13. The stabilizing turning aid system of claim 1 wherein said padded cross bar is adapted to allow said user to lean on as needed for stabilization.

14. The stabilizing turning aid system of claim 13 wherein said padded cross bar provides vertical stability of said hand rails for safety.

15. The stabilizing turning aid system of claim 1 wherein said toe stop keeps said user from slipping when stepping on said base plate for safety.

16. The stabilizing turning aid system of claim 15 wherein said toe stop is adapted to guide said user's feet to an ideal standing position on said base plate, which is directly over said bearing assembly for ideal weight distribution, and proper bearing operation.

17. The stabilizing turning aid system of claim 1 wherein said plurality of glide pads are mounted on said bottom side of said base plate to provide horizontal stability of said base plate while in use.

18. The stabilizing turning aid system of claim 17 wherein said plurality of glide pads rotate in conjunction with said bearing assembly when rotation of said base plate is executed.

19. The stabilizing turning aid system of claim 18 wherein said plurality of glide pads comprise a material which will not scratch a floor when rotating said base plate.

20. The stabilizing turning aid system of claim 1 wherein said stabilizing turning aid system is adapted to be left in place after use until necessary to move said user again as needed.

* * * * *